US006931995B2

(12) United States Patent
Yokonishi et al.

(10) Patent No.: US 6,931,995 B2
(45) Date of Patent: Aug. 23, 2005

(54) TRAIN MAINTENANCE AUTOMATING SYSTEM

(75) Inventors: Toshio Yokonishi, Nagoya (JP); Hisao Sawada, Nagoya (JP); Dai Koyama, Nagoya (JP); Kenjiro Fujii, Tokyo (JP); Kazuhiro Makino, Tokyo (JP)

(73) Assignee: Central Japan Railway Company, Aichi (JP)

( * ) Notice: Subject to any disclaimer, the term of this patent is extended or adjusted under 35 U.S.C. 154(b) by 0 days.

(21) Appl. No.: 10/415,075

(22) PCT Filed: Jul. 30, 2001

(86) PCT No.: PCT/JP01/06570

§ 371 (c)(1),
(2), (4) Date: Apr. 25, 2003

(87) PCT Pub. No.: WO02/34602

PCT Pub. Date: May 2, 2002

(65) Prior Publication Data

US 2004/0099176 A1 May 27, 2004

(30) Foreign Application Priority Data

Oct. 25, 2000 (JP) ..... 2000-325487

(51) Int. Cl.[7] ..... B61J 7/02
(52) U.S. Cl. ..... 104/26.1; 104/27; 104/307
(58) Field of Search ..... 104/26.1, 27, 29, 104/30, 26.2, 88.01, 88.02, 88.03, 307; 701/29, 19, 205

(56) References Cited

U.S. PATENT DOCUMENTS 2,010,350 A * 8/1935 Davis ..... 280/849
2,778,508 A * 1/1957 Beger ..... 213/211
3,649,958 A * 3/1972 Koerner ..... 340/938
5,398,619 A * 3/1995 Buccos ..... 105/157.2
5,758,848 A * 6/1998 Beule ..... 246/182 B
6,161,064 A * 12/2000 Strasser et al. ..... 701/19
6,453,823 B1 * 9/2002 Barich et al. ..... 104/307

FOREIGN PATENT DOCUMENTS

JP 135010 A * 11/1976
JP 51-135010 A 11/1976
JP 6-257196 A 9/1994
JP 7-257373 A 10/1995
JP 8-127339 A 5/1996

* cited by examiner

*Primary Examiner*—Frantz F. Jules
(74) *Attorney, Agent, or Firm*—Sughrue Mion, PLLC

(57) ABSTRACT

An automation system for train maintenance that performs operations related to train maintenance without human intervention is provided. The automation system for train maintenance comprises a refuse reservoir (10), a sewage tank (20), a water tank (30), and expanders (41, 42, 51, 61). In this automation system, when a railway vehicle is parked, the expanders (41, 42, 51, 61) are expanded to lift connectors (45, 54, 64) toward the railway vehicle for connection to the refuse reservoir (10), sewage tank (20), and water tank (30). In this automation system, discharge of refuse, removal of sewage, and feeding of water are automatically performed. Upon completion of these operations, the expanders (41, 42, 51, 61) are contracted so that the connectors (44, 45, 54, 55, 64, 65) are stored in waiting locations (48, 58). Therefore, use of this automation system for train maintenance allows automatic train maintenance without human intervention.

8 Claims, 11 Drawing Sheets

10
13
134
130
132
136
138
45
453
420
43
451

10
13
134
130
132
136
45
453
420
43
451

10
13
134
130
132
136
45
453
420
43
451

182
47

14
AIR
AIR 122
13
45
44
42
41

12
REFUSE
AIR 182
14
47
130
132

TRAIN MAINTENANCE AUTOMATING SYSTEM

TECHNICAL FIELD OF THE INVENTION

This invention relates to an automation system for train maintenance.

BACKGROUND OF THE INVENTION

Conventionally, a railway vehicle forming a train like a bullet train is equipped with a refuse reservoir for storing refuse produced inside the vehicle, a water tank for storing water such as drinking water, and a sewage tank for storing sewage produced inside the vehicle. Those reservoir and tanks are provided in the lower part of the vehicle.

Operations for train maintenance, like removal of refuse from the refuse reservoir, feeding of water to the water tank and suction of sewage from the sewage tank, are performed at train stations where the train stops and in train maintenance grounds.

Among the above mentioned operations, removal of refuse is performed directly by a laborer who opens a lid, provided on the outer side of the vehicle and covering a passage leading the refuse reservoir, and takes out the refuse collected in the reservoir by hand.

Feeding of water is also performed by a laborer, who attaches a hose extending from a feed pump provided on the ground to a faucet of the water tank manually. Suction of sewage is also performed by a laborer, who attaches a hose extending from a suction pump provided on the ground to suck the sewage to a faucet of the sewage tank manually.

However, such operations are so-called three-K (a coined word generated from the first letter of three adjectives in Japanese language, that is, "Kiken (dangerous)", "Kitanai (dirty)" and "Kitsui (hard)") operations. Therefore, there are not many young people who are willing to take over such operations. This tendency is expected to go high in the near future, due to decline of the birthrate. Accordingly, automation of such operations has been desired.

In addition, the laborer will be exposed to a magnetic field of a super conductive magnet during the operations if the maintenance of a railway vehicle forming a maglev train is performed in the conventional manner. To avoid such danger, the super conductive magnet has to be demagnetized. Once the super conductive magnet is demagnetized, however, it takes long to magnetize the super conductive magnet once again. Thus operating performance of the train is lowered. Moreover, on a track of the maglev train, a guideway for guiding a maglev train is provided. Since the sidewalls of th e guideway, which stand on both sides of the maglev train, hinder easy access to the lower part of the vehicle, automation of such train maintenance operations is strongly desired in this field.

SUMMARY OF THE INVENTION

One object of the pre sent invention is to provide an automation system for train maintenance, which allows maintenance of a train without human intervention.

In order to attain the above object, the present invention set forth provides an automation system for train maintenance which maintains a train while the train is parked. The system comprises storing means provided on a railway vehicle forming a train, feeding/discharging means provided on the ground for feeding the storage to be supplied to and discharge the storage to be discharged from the storing means via a feeding/discharging opening, and feeding/discharging opening shifting means for access movement, that is, moving the feeding/discharging opening of the feeding/discharging means toward the railway vehicle from the waiting location on the ground to connect the opening to the storing means and for disconnection movement, that is, moving the feeding/discharging opening connected to the storing means away from the railway vehicle toward the waiting location to disconnect the opening from the storing means. The system further comprises parking determination means for determining whether the train is parked, connection determination means for determining whether the feeding/discharging means is connected to the storing means, feeding/discharging completion determination means for determining whether the feeding of the storage to be supplied or discharge of the storage to be discharged is completed, access control means for urging the feeding/discharging means to perform the access movement when the parking determination means determines that the train is parked, feeding/discharging movement control means for urging the feeding/discharging means to feed the storage to be supplied or discharge storage to be discharged when the connection determination means determines that the feeding/discharging opening is connected to the storing means, and disconnection movement control means for urging the feeding/discharging opening shifting means to perform the disconnection movement when the feeding/discharging completion determination means determines that the feeding of the storage to be supplied or discharge of the storage to be discharged is completed.

The automation system for train maintenance of the present invention provides the feeding/discharging means and the feeding/discharging opening shifting means for moving the feeding/discharging opening of the feeding/discharging means toward or away from the railway vehicle on the ground. The feeding/discharging opening is moved toward the railway vehicle from the waiting location to be connected to the storing means when it is determined that the train is parked, and is disconnected from the storing means when it is determined that the feeding of the storage to be supplied or discharge of the storage to be discharged is completed. In this way, the operation for connecting and disconnecting the feeding/discharging opening to and from the storing means is automatically performed. Furthermore, the automation system of the present invention activates the feeding/discharging means when it is determined that the feeding/discharging opening is connected to the storing means and inactivates the feeding/discharging means when it is determined that the feeding of the storage to be supplied or discharge of the storage to be discharged is completed. In this way, the operation for feeding the storage to be supplied or discharging the storage to be discharged is automatically performed when the feeding/discharging opening is connected to the storing means. In other words, the automation system for train maintenance of the present invention automates the operations relating to the train maintenance by automatically performing the operation for connecting and disconnecting the feeding/discharging opening to and from the storing means and the operation for feeding the storage to be supplied and discharging of the storage to be discharged by way of the feeding/discharging means. Accordingly, the automation system for train maintenance of the present invention allows automatic train maintenance without human intervention.

For example, if the storing means is a refuse reservoir, the storage to be discharged is refuse, etc. produced inside the vehicle, and if the storing means is a sewage tank, the storage to be discharged is sewage like excreta and the storage to be supplied is water, etc. to fluidify the sewage. If the storing means is a water tank, the storage to be supplied and discharged is drinking water, etc., and if the storing means is a fuel tank, the storage to be supplied is fuel. Various other combinations of the storing means and the storage to be supplied and discharged can be considered.

The invention set forth provides the automation system for train maintenance as set forth that further comprises traveling direction shifting means. When the parking determination means determines that the train is parked, the access movement control means urges the traveling direction shifting means to move the feeding/discharging opening to the predetermined position if there is a gap between the actual parking position where the train is actually parked and the predetermined parking position where the train is to be parked, and urges the feeding/discharging opening shifting means to perform the access movement. In this case, if the vehicle is not parked at the predetermined position, the feeding/discharging opening is moved to the position where the train maintenance is possible to eliminate the gap between the actual parking position and the predetermined parking position. Accordingly, the automation system for train maintenance of the present invention allows automatic train maintenance even if the railway vehicle is not parked at the right position.

The invention set forth provides the automation system for train maintenance as set forth wherein the feeding/discharging opening shifting means is formed from vibration absorbent which absorbs vibration of the railway vehicle. In this case, even if the vehicle vibrates during getting on and off of the passengers, the feeding/discharging opening shifting means also vibrates to the vibration so as not to disconnect the feeding/discharging opening from the storing means. Accordingly, the automation system for train maintenance of the present invention allows reliable maintenance of the railway vehicle even during getting on and off of the passengers. Particularly, as set forth, it is preferable that the feeding/discharging opening shifting means is constituted from a multiple-layered airing which is composed of expandable airings that are layered in their expanding direction.

The invention set forth discloses the automation system for train maintenance as set forth wherein the storing means is provided with grinding means for grinding the storage to be discharged inside the storing means. The automation system for train maintenance of the present invention grinds the storage to be discharged stored in the storing means, and thus ensures discharge of the storage to be discharged like refuse that is larger than the opening area of the feeding/discharging opening.

In the invention set forth, the feeding/discharging means includes vacuuming means for vacuuming the storage to be discharged from the storing means. The storing means comprises a lid capable of sealing a mouth provided in the passenger cabin of the railway vehicle for throwing the storage to be discharged into the storing means and air supplying means for supplying the air to the storing means. While the storage to be discharged is being vacuumed by the vacuuming means, the mouth is sealed with the lid and the air is supplied to the storing means by the air supplying means. In the automation system for train maintenance of the present invention, the mouth provided in the passenger cabin is sealed with the lid while the storage to be discharged like refuse is being vacuumed. Therefore, suction of the air in the passenger cabin is avoided and thus, discharge of the storage to be discharged can be performed without offending the passengers. Furthermore, in the automation system for train maintenance of the present invention, the air supplying means supplies the air to the storing means while the air is being vacuumed. Therefore, even if the air present at the beginning inside the storing means sealed by sealing of the mouth is sucked, continuous discharge of the storage to be discharged is possible owing to the supplied air. Moreover, collapse of the storing means is avoided even if the air pressure inside the storing means is lowered.

Then, as set forth, it is preferable that the air supplying means diffuses the storage to be discharged toward the direction of the discharge opening by means of the air supplied into the storing means. In this way, the storage to be discharged inside the storing means is diffused and can be discharged without being stuck inside the storing means.

The invention set forth provides the automation system for train maintenance as set forth that further comprises female connecting means that is provided in one of a connection opening of the storing means and the feeding/discharging opening of the feeding/discharging means. The female connecting means is formed into a taper so that the opening area of the female connecting means is enlarged toward the tip. The automation system for train maintenance also comprises male connecting means, for being connected to the female connecting means, that is provided in the other of the connection opening of the storing means and the feeding/discharging opening of the feeding/discharging means. The access movement means urges the feeding/discharging opening shifting means to perform the access movement when the female connecting means faces the male connecting means. In this manner, even if the railway vehicle is not parked at the right position and the feeding/discharging opening is thus more or less off the position to be attached to the storing means, the male connecting means can move its position along the taper of the female connecting means, if only the male connecting means is positioned within the opening area of the female connecting means. Thus the feeding/discharging opening is guided to the position where it can be connected to the storing means, while the feeding/discharging opening is being moved toward the vehicle. Therefore, the connection of the feeding/discharging opening to the storing means is ensured.

The invention set forth provides isolation means for preventing fluctuation of the air pressure from affecting the environment inside the railway vehicle through an opening provided on the vehicle for connecting the feeding/discharging opening to the storing means installed in the vehicle. Then, fluctuation of the air pressure which may be caused by passing of the other trains during the train maintenance does not affect the air inside the vehicle, and thus the environment in the passenger cabin can be comfortably maintained.

BRIEF DESCRIPTION OF THE DRAWINGS

FIGS. 4A–4C are cross sectional views of a faucet and a connector of the first feeding/discharging opening shifting means, in which FIG. 4A shows the view before connecting the faucet to the connector, FIG. 4B shows the view after the connection, and FIG. 4C shows the view of communication to a storing portion;

FIGS. 5A–5C are cross sectional views of a faucet and a connector of the second feeding/discharging opening shifting means, in which FIG. 5A shows the view before connecting the faucet to the connector, FIG. 5B shows the view after the connection, and FIG. 5C shows the view in the middle of discharge of sewage;

FIGS. 6A–6C are cross sectional views of a faucet and a connector of the third feeding/discharging shifting opening means, in which FIG. 6A shows the view before connecting the faucet to the connector, FIG. 6B shows the view after the connection, and FIG. 6C shows the view in the middle of feeding of water;

DETAILED DESCRIPTION OF THE PREFERRED EMBODIMENT

The invention will now be described, by way of example, with reference to the accompanying drawings.

Figure 1:
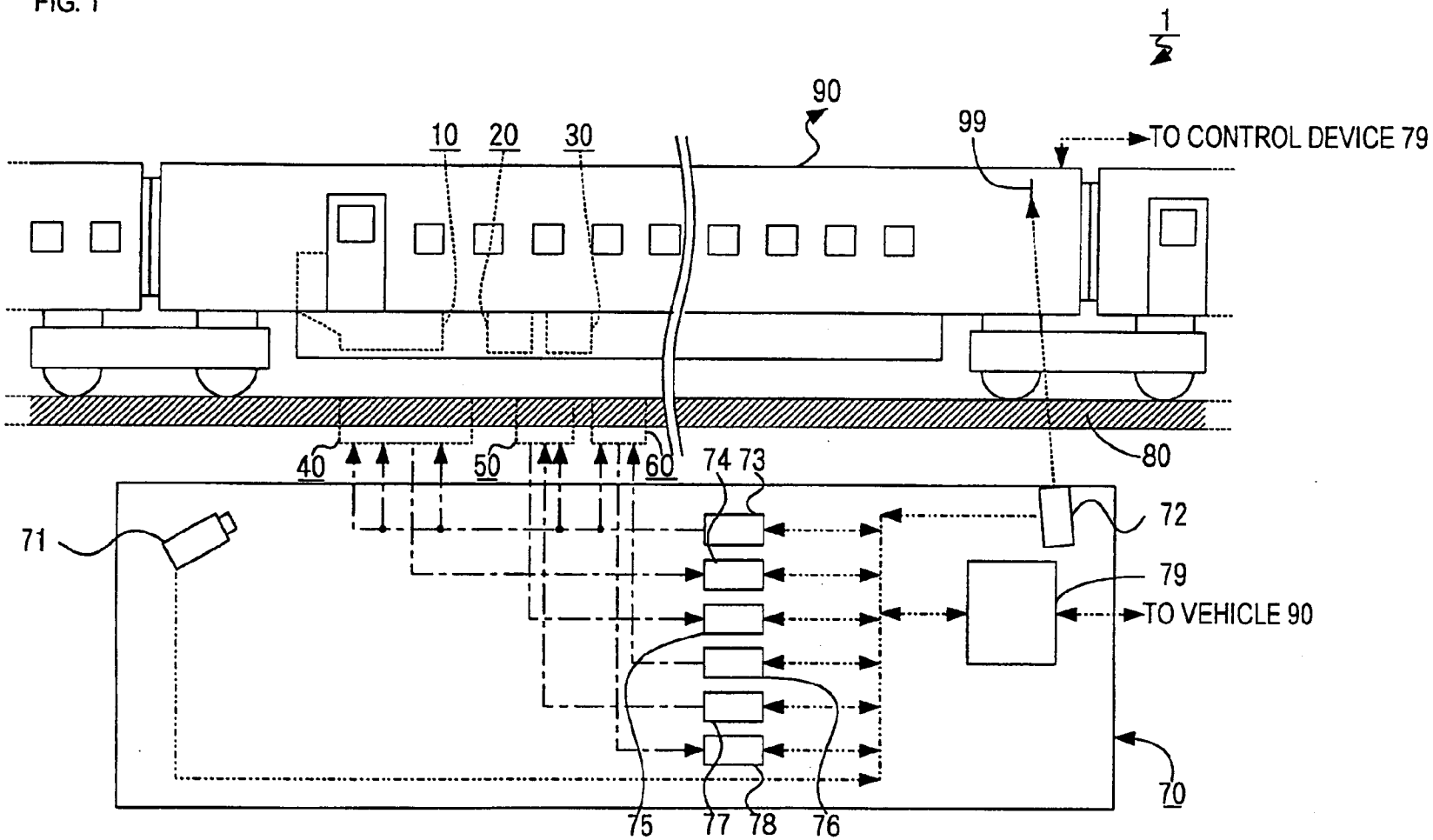
FIG. 1 shows an automation system for train maintenance of the present embodiment as a whole.
Figure 2:
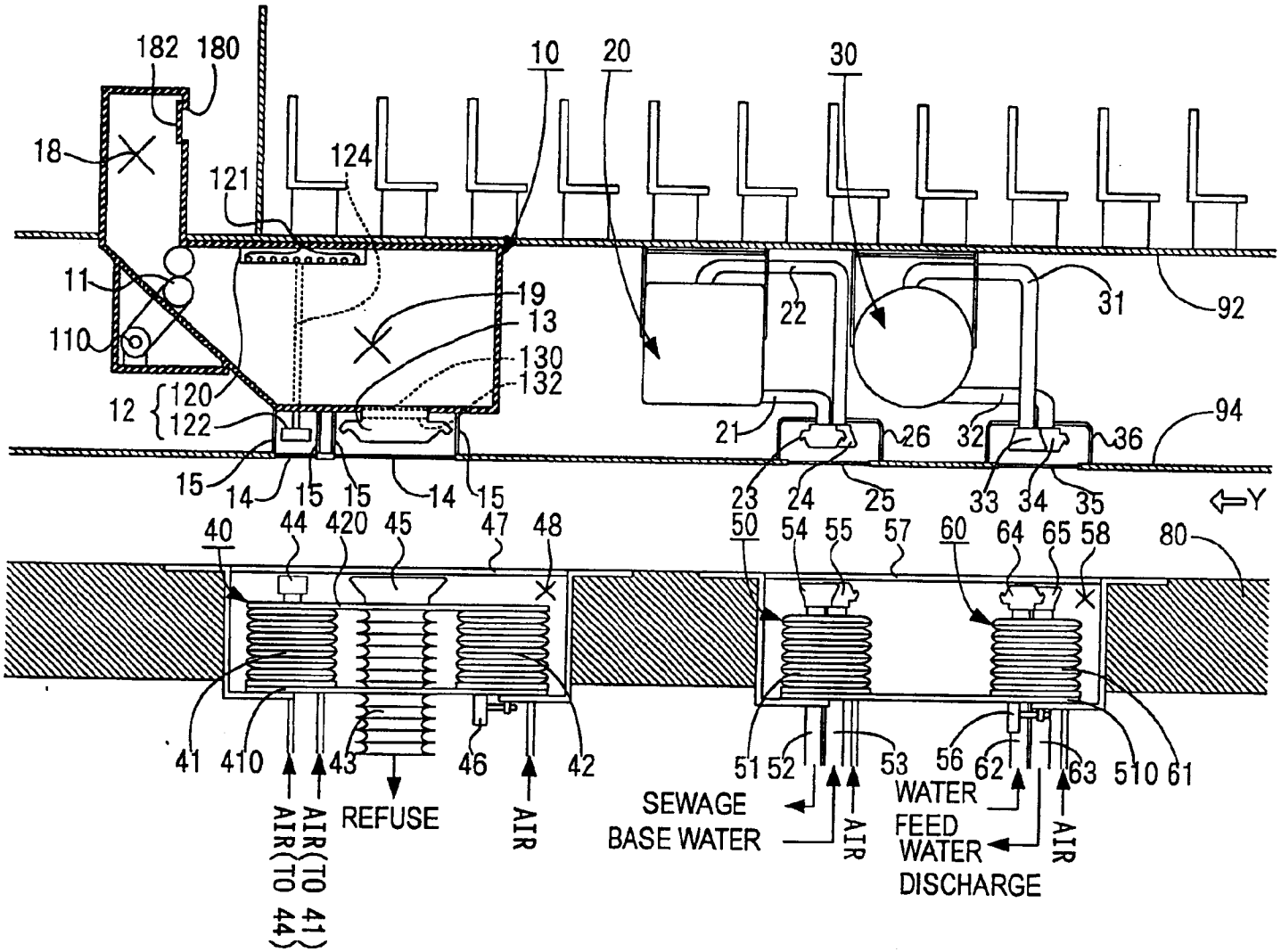
FIG. 2 is a layout plan of first to third feeding/discharging opening shifting devices, a refuse reservoir, a sewage tank and a water tank to a railway vehicle and a travel passage.
Figure 3:
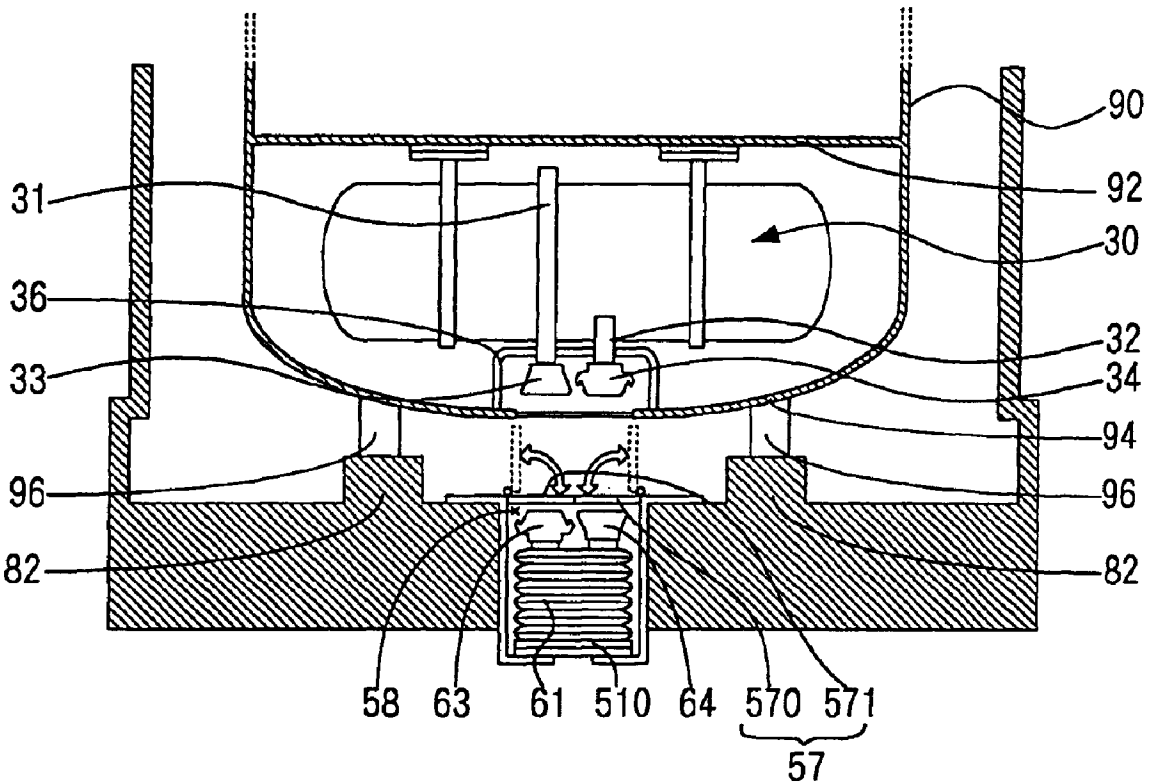
FIG. 3 is a layout plan of the third feeding/discharging opening shifting device and water tank, viewed from the traveling direction of the railway vehicle.
Figures 4A, 4B, 4C:
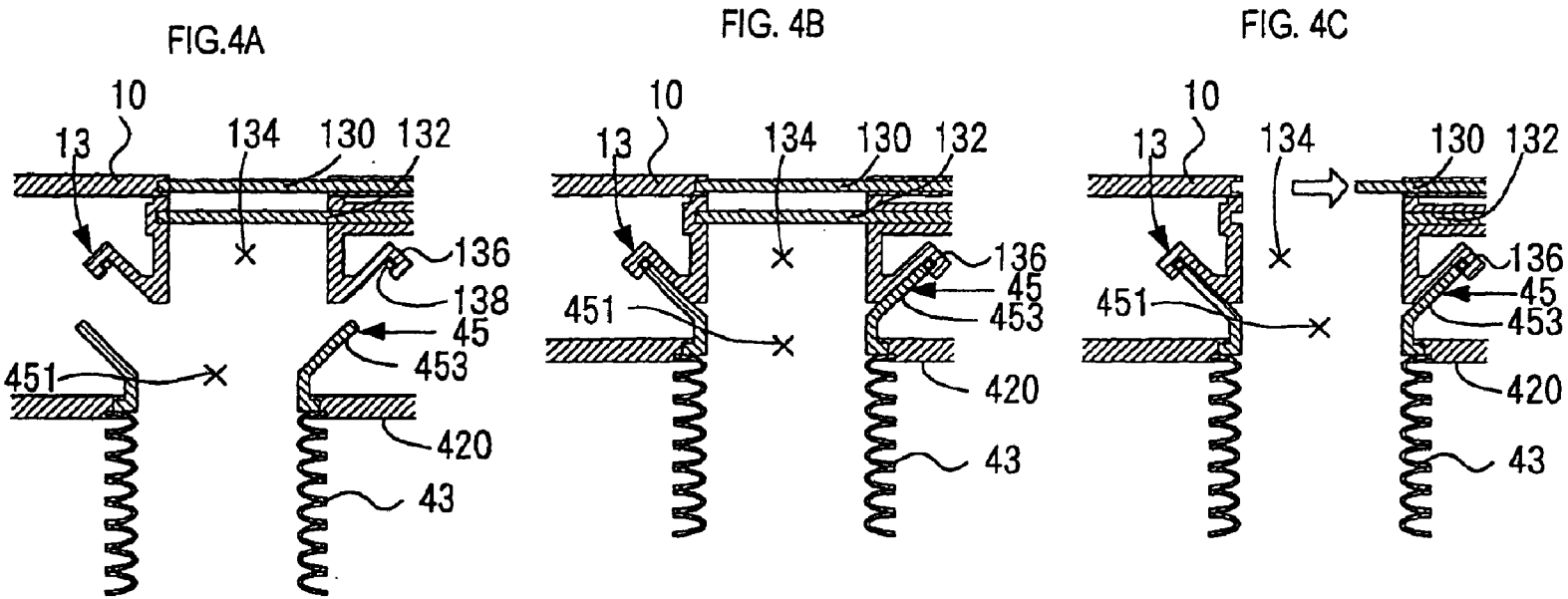
Figure 5B:
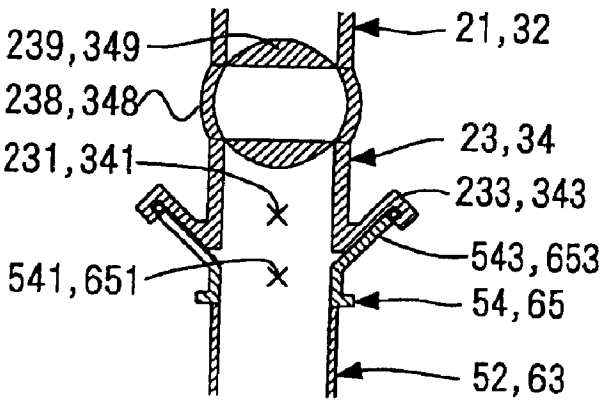
Figure 5C:
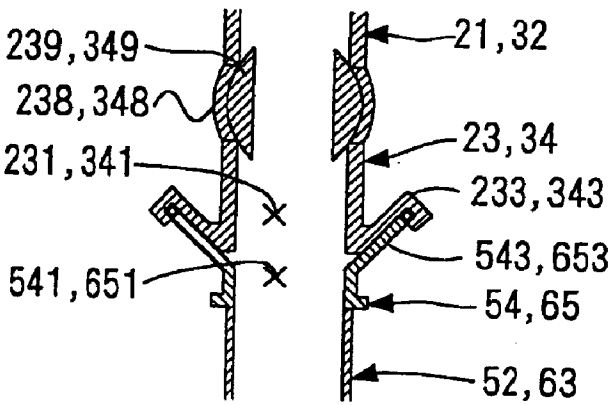
Figure 5A:
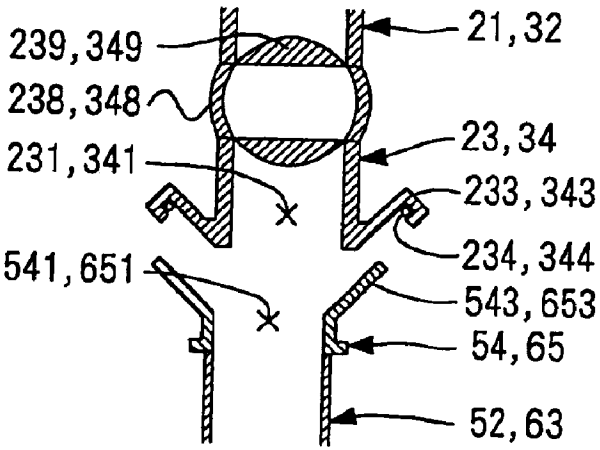
Figure 6B:
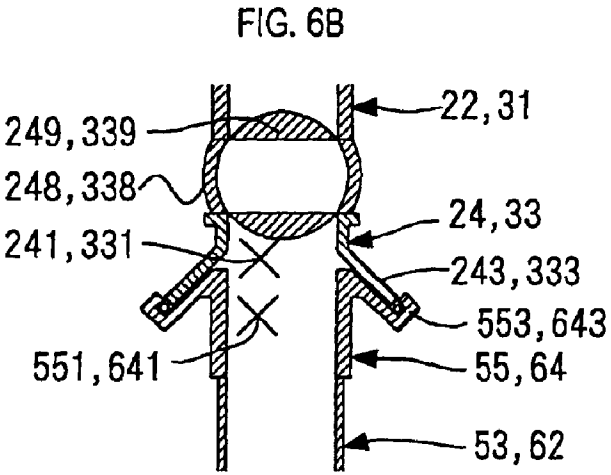
Figure 6A:
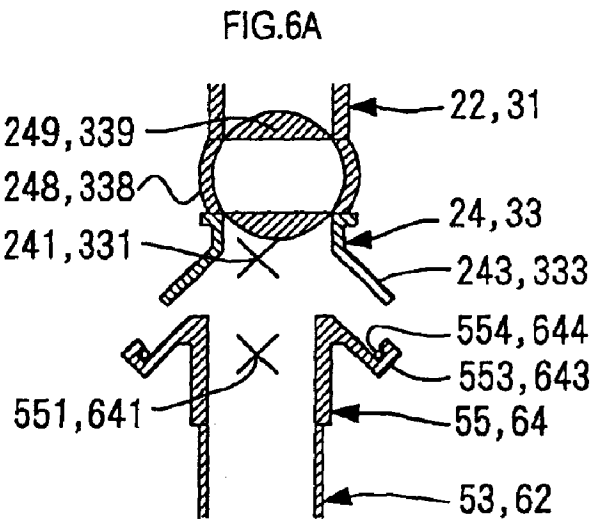
Figure 6C:
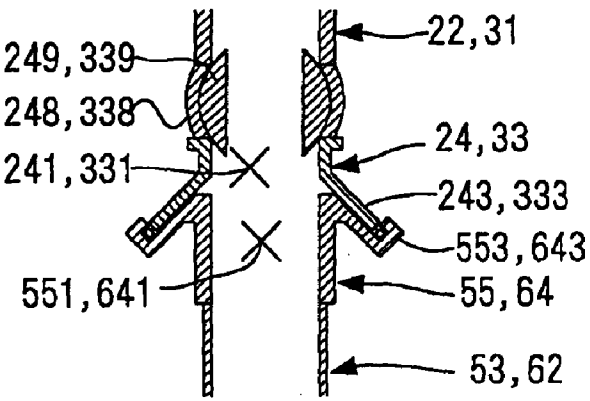

FIG. 1 shows an automation system for train maintenance of the present embodiment as a whole. FIG. 2 is a layout plan of first to third feeding/discharging opening shifting devices, a refuse reservoir, a sewage tank and a water tank to a railway vehicle and a travel passage. The sewage reservoir is shown in perspective. FIG. 3 is a layout plan of the third feeding/discharging opening shifting device and water tank, viewed from the traveling direction (arrow Y direction in FIG. 2) of the railway vehicle. FIGS. 4A–4C are cross sectional views of a connector of the first feeding/discharging opening shifting device and a faucet of the refuse reservoir. FIG. 4A shows the view before connecting the faucet to the connector, FIG. 4B shows the view after the connection, and FIG. 4C shows the view when an inner partition is removed. FIGS. 5A–5C are cross sectional views of a connector of the second feeding/discharging opening means and a faucet of the sewage tank. FIG. 5A shows the view before connecting the faucet to the connector, FIG. 5B shows the view after the connection, and FIG. 5C shows the view when a valve is open. FIGS. 6A–6C are cross sectional views of a connector of the third feeding/discharging opening means and a faucet of the water tank. FIG. 6A shows the view before connecting the faucet to the connector, FIG. 6B shows the view after the connection, and FIG. 6C shows the view when a valve is open.

An automation system 1 of the present embodiment comprises a refuse reservoir 10, a sewage tank 20, a water tank 30, a first feeding/discharging opening shifting device 40, a second feeding/discharging opening shifting device 50, a third feeding/discharging opening shifting device 60, and ground equipment 70, as shown in FIG. 1. This automation system 1 is controlled by a control device 79 provided with the ground equipment 70. Transmission and reception of control signals exchanged between the ground equipment 70 and a railway vehicle 90 are performed via the existing communication facility which allows communication between the railway vehicle 90 side and the ground side.

Constitution of the refuse reservoir 10 is now described.

The refuse reservoir 10, as shown in FIG. 2, is placed under a floor 92 which forms a passenger cabin of the railway vehicle 90 (see FIG. 1). It comprises a grinder 11, a compressed air supplying unit 12, a faucet 13, a body side cover 14, and a partition wall 15. Part of the refuse reservoir 10 extends above the floor 92. The extended portion is referred to as a trash box portion 18, and the portion to which the refuse sent from the trash box portion 18 is stored is referred to as a storing portion 19 hereafter. This refuse reservoir 10 corresponds to the storing means of the present invention, and the refuse to be stored in the refuse reservoir 10 corresponds to the storage to be discharged. The partition wall 15 corresponds to the isolation means of the present invention.

The grinder 11 is positioned in the vicinity of the boundary between the trash box portion 18 and the storing portion 19. It grinds the refuse thrown into the trash box portion 18 and carries the ground refuse into the storing portion 19. The grinder 11 detects a drop of the refuse into the trash box portion 18, and is activated for a predetermined period of time. This grinder 11 is driven by a motor 110 provided outside the refuse reservoir 10. The grinder 11 may be operated at all times during the railway vehicle 90 is in service.

The compressed air supplying unit 12 comprises a spouting unit 120 and a faucet 122. The spouting unit 120 is arranged in the ceiling part of the storing portion 19. The faucet 122 is arranged between the bottom of the refuse reservoir 10 and a bottom part 94 of the railway vehicle 90. The spouting unit 120 and the faucet 122 are connected to each other via a pipe 124 provided along the outer periphery of the refuse reservoir 10. The spouting unit 120 comprises a plurality of nozzles 121. In this compressed air supplying unit 12, the faucet 122 is connected to a connector 44 of the first feeding/discharging opening shifting device 40. As the compressed air is sent from the first feeding/discharging opening shifting device 40, the compressed air spouts from the nozzles 121 of the spouting unit 120 toward the refuse. The compressed air supplying unit 12 and a compressed air pump 73 (see FIG. 1) composing the ground equipment 70 correspond to the air supplying means of the present invention.

The faucet 13 is attached to the bottom of the refuse reservoir 10. As shown in FIG. 4A, it has a discharging hole 134 for discharging the refuse collected in the storing portion 19 to the outside. The faucet 13 is provided with a first inner partition 130 for closing the discharging hole 134 on the storing portion 19 side, and a second inner partition 132 for closing the discharging hole 134 on the more outer side than the first inner partition 130. These inner partitions 130, 132 open and close the discharging hole 134 according to instructions from the control device 79. The faucet 13 also comprises a male connecting portion 136 of which periphery of an end to which the connector 45 is to be connected is turned up to form an umbrella-like shape. In a groove provided on the tip of the turnup, a gasket 138 is provided so that the airtight connection between the male connecting portion 136 and a female connecting portion 453 can be realized. The first inner partition 130, which directly separates the inner side of the refuse reservoir 10 from the outside, is for isolation of the refuse. The second inner partition 132, which separates the inner side of the refuse reservoir 10 from the outside on the more outer side than the first inner partition 130, is for securing the airtight condition. In this manner, even if the first inner partition 130 does not close completely owing to the stuck refuse, etc., the second inner partition can succeed in separating the inner side of the refuse reservoir 10 from the outside in the airtight manner.

The body side cover 14 is arranged on the bottom part 94 facing the faucets 122 and 13, as shown in FIG. 2. It is opened and closed according to instructions from the control device 79. The body side cover 14 allows the connector 44 to be connected to the faucet 122 as well as the connector 45 to be connected to the faucet 13 externally.

The partition wall 15 is arranged to surround a space between the refuse reservoir 10 and the bottom part 94. In the space, the faucets 122 and 13 are arranged. The partition wall 15 is so arranged that it separates the inner side of the railway vehicle 90 from the outside in the airtight manner when the body side cover 14 is opened. The partition wall 15 is provided so that the change in the air pressure which may be caused when the other trains pass the station does not affect the air in the passenger cabin.

The trash box portion 18 is provided with a mouth 180 on the side of its upper portion. It is also provided with a lid 182 for opening and closing the mouth 180. The lid 182 can be locked by instructions from the control device 79 and close the trash box 18 in the airtight manner.

Now, constitution of the sewage tank 20 is explained.

The sewage tank 20 is provided under the floor 92.

It comprises a sewage discharging duct 21, a water feeding duct 22, a faucet 23, a faucet 24, a body side cover 25, and a partition wall 26. The sewage like waste water produced in a toilet and lavatory installed in the railway vehicle 90 is collected in the sewage tank 20. The sewage tank 20 corresponds to the storing means of the present invention, the sewage to be collected corresponds to the storage to be discharged, and the partition 26 corresponds to the isolation means.

The sewage discharging duct 21 is connected to the bottom part of the sewage tank 20. The sewage inside the sewage tank 20 is discharged to the outside through the faucet 23.

The water feeding duct 22 is a duct for feeding base water into the sewage tank 20 after removal of the sewage. It feeds base water supplied from the outside through the faucet 24 into the sewage tank 20. This base water prevents the sewage from being stuck to the sewage tank 20 while the sewage is stored inside the sewage tank 20. Being discharged with the sewage, it also helps smooth discharge of the sewage from the sewage tank 20 and cleans the inside of the sewage tank 20.

The faucet 23 is connected to the sewage discharging duct 21 via a rotary valve 238, as shown in FIG. 5A. It has a communicating hole 231 leading to the sewage discharging duct 21. By rotating a valve 239 according to instructions from the control device 79, the rotary valve 238 allows communication between the communicating hole 231 and the sewage discharging duct 21, as shown in FIG. 5C. The faucet 23 comprises a male connecting portion 233 of which periphery of an end to which a connector 54 of the second feeding/discharging opening shifting device 50 is to be connected is turned up to form an umbrella-like shape. In a groove provided on the tip of the turnup, a gasket 234 is provided so that the airtight connection between a female connecting portion 543 and the male connecting portion 233 can be realized.

The faucet 24 is connected to the base water feeding duct 22 via a rotary valve 248, as shown in FIG. 6A. It has a communicating hole 241 leading to the base water feeding duct 22. By rotating a valve 249 according to instructions from the control device 79, the rotary valve 248 allows communication between the communicating hole 241 and the base water feeding duct 22, as shown in FIG. 6C. The faucet 24 comprises a female connecting portion 243 formed into a taper so that the opening area is enlarged toward the tip, on the periphery of an end of the faucet 24 which is to be connected to a connector 55 of the second feeding/discharging opening shifting device 50.

The body side cover 25 is arranged on the bottom part 94 facing the faucets 23 and 24, as shown in FIG. 2.

It is opened and closed according to instructions from the control device 79. The body side cover 25 allows the connector 54 to be connected to the faucet 23 as well as the connector 55 to be connected to the faucet 24 externally.

The partition wall 26 is arranged to surround a space between the faucets 23, 24. It is so arranged that it separates the inner side of the railway vehicle 90 from the outside in the airtight manner when the body side cover 25 is opened. The partition wall 26, like the partition wall 15, is provided so that the change in the air pressure which may be caused when the other trains pass the station does not affect the air in the passenger cabin.

Constitution of the water tank 30 is now described.

The water tank 30 is provided under the floor 92. It comprises a water feeding duct 31, a water discharging duct 32, a faucet 33, a faucet 34, a body side cover 35, and a partition wall 36. Water to be used as drinking water and washing water in a water feeder, a lavatory and toilet installed in the railway vehicle 90 is stored in the water tank 30. The water tank 30 corresponds to the storing means of the present invention. The water to be stored in the water tank 30 corresponds to the storage to be fed.

The water feeding duct 31 is connected to the ceiling of the water tank 30. The water supplied from the outside through the faucet 33 is fed into the water tank 30.

The water discharging duct 32 is connected to the bottom of the water tank 30. It discharges water stored inside the water tank 30 through the faucet 34.

The water tank 30 is designed to discharge the water after a predetermined period of time. Accordingly, this water discharging duct 32 is used to discharge water inside the water tank 30 after the predetermined period of time. In the present embodiment, discharge of the water in the water tank 30 may be performed when necessary, without fixing the time interval.

The faucet 33 is connected to the water feeding duct 31 via a rotary valve 338, as shown in FIG. 6A. It has a communicating hole 331 leading to the water feeding duct 31. By rotating a valve 339 according to instructions from the control device 79, the rotary valve 338 allows communication between the communicating hole 331 and the water feeding duct 31, as shown in FIG. 6C. The faucet 33 comprises a female connecting portion 333 formed into a taper so that the opening area is enlarged toward the tip, on the periphery of an end of the faucet 33 which is to be connected to a connector 64 of the third feeding/discharging opening shifting device 60.

The faucet 34 is connected to the water discharging duct 32 via a rotary valve 348, as shown in FIG. 5A. It has a communicating hole 341 leading to the water discharging duct 32. By rotating a valve 349 according to instructions from the control device 79, the rotary valve 348 allows communication between the communicating hole 341 and the water discharging duct 32, as shown in FIG. 5C. The faucet 34 comprises a male connecting portion 343 of which periphery of an end to which a connector 64 of the third feeding/discharging opening shifting device 60 is to be connected is turned up to form an umbrella-like shape. In a groove provided on the tip of the turnup, a gasket 344 is provided so that the airtight connection between a female connecting portion 653 and the male connecting portion 343 can be realized.

The body side cover 35 is arranged on the bottom part 94 facing the faucets 33 and 34, as shown in FIG. 2.

It is opened and closed according to instructions from the control device 79. The body side cover 35 allows the connector 64 to be connected to the faucet 33 as well as the connector 65 to be connected to the faucet 34 externally.

The partition wall 36 is arranged to surround a space between the faucets 33, 34. It is so arranged that it separates the inner side of the railway vehicle 90 from the outside in the airtight manner when the body side cover 35 is opened. The partition wall 36, like the partition wall 15, is provided so that the change in the air pressure which may be caused when the other trains pass the station does not affect the air in the passenger cabin. The partition wall 36 corresponds to the isolation means of the present invention.

Constitution of the first feeding/discharging opening shifting device 40 is explained hereafter.

This first feeding/discharging opening shifting device 40 comprises expanders 41, 42, a refuse discharging duct 43, a connector 44, a connector 45, a shifter 46, and a ground side cover 47. The first supply/discharging opening shifting device 40 is installed within a waiting location 48 excavated about in the middle of travel passages 82, 82 with which a pair of wheels 96, 96 (see FIG. 3) of the railway vehicle 90 are in contact.

The expanders 41, 42 are constituted from a multiple-layered airing which is composed of a plurality of expandable airings that are layered in their expanding direction. Each of the airings is designed to be expanded perpendicularly toward the railway vehicle 90 from the waiting location 48, when the compressed air is supplied from the ground equipment 70. These expanders 41, 42 are arranged along the traveling direction of the railway vehicle 90 on both sides of the refuse discharging duct 43, and are placed on the respective end portions of a longitudinal bottom beam 410. Above the expanders 41, 42, a ceiling beam 420 is provided so that the expanders 41, 42 can cooperate to lift the connector 45 toward the railway vehicle 90 (see FIG. 1). The reason why the multiple-layered airing is used as the expanders 41, 42 is to prevent disconnection between the coupled faucet 14 and connector 45, etc. owing to the vibration caused during getting on and off of the passengers. In other words, this multiple-layered airing twists and turns to the vibration of the railway vehicle 90 so as not to disconnect the coupled faucet 13 and connector 45.

The refuse discharging duct 43 is for sending the refuse collected inside the refuse reservoir 10 to the ground equipment 70 side. This refuse discharging duct 43 is formed of a bellows-like expandable duct so that it can be expanded and contracted along with expansion and contraction of the expanders 41, 42.

The tip of the refuse discharging duct 43 is fixed to the back side of the ceiling beam 420 on which the connector 45 is placed.

The connector 44 is for relaying the compressed air from the ground equipment 70 (see FIG. 1) to the compressed air supplying unit 12. It is provided in the middle of the ceiling part of the expander 41 and is for being connected to the faucet 122.

The connector 45 is attached to the middle part of the longitudinal length of the ceiling beam 420 extending over the expanders 41, 42. As shown in FIG. 4A, it has a communicating hole 451 which allows communication between the refuse discharging duct 43 and the outside. The connector 45 also has a female connecting portion 453 formed into a taper so that the opening area of the female connecting portion 453 is enlarged toward the tip, on the periphery of an end of the connector 45 to which the faucet 13 is to be connected.

The shifter 46 is provided under the bottom beam 410. It moves the expanders 41, 42 placed on the bottom beam 410 along the traveling direction of the railway vehicle 90 according to instructions from the control device 79. This shifter 46 corresponds to the traveling direction shifting means of the present invention.

The ground side cover 47 is arranged on the ceiling part of the waiting location 48. It is opened and closed according to instructions from the control device 79.

Constitution of the second feeding/discharging opening shifting device 50 is explained hereafter.

This second feeding/discharging opening shifting device 50 comprises an expander 51, a refuse discharging duct 52, a base water feeding duct 53, a connector 54, a connector 55, a shifter 56, and a ground side cover 57. The second supply/discharging opening shifting device 60 is installed within a waiting location 58 excavated about in the middle of the travel passages 82, 82 with which the pair of wheels 96, 96 (see FIG. 3) of the railway vehicle 90 are in contact.

The expander 51 is constituted from a multiple-layered airing which is composed of a plurality of expandable airings that are layered in their expanding direction. Each of the airings is designed to be expanded perpendicularly toward the railway vehicle 90 from the waiting location 58, when the compressed air is supplied from the ground equipment 70. This expander 51 is arranged above an end of a longitudinal bottom beam 510 extending along the traveling direction of the railway vehicle 90.

The refuse discharging duct 52 is for sending the sewage collected inside the sewage tank 20 to the ground equipment 70 side via the sewage discharging duct 21. It is connected to the ground equipment 70 side through the middle of a ring of the expander 61. This sewage discharging duct 52 is a flexible tube, and has a sufficient length on the ground side to be capable of being moved by the expander 51.

The base water feeding duct 53 is for supplying the base water into the sewage tank 20 from the ground equipment 70 side via the base water feeding duct 22. It is connected to the ground equipment 70 side through the middle of the ring of the expander 51. This base water feeding duct 53 is also a flexible tube, and has a sufficient length on the ground side to be capable of being moved by the expander 51.

The connector 54 is connected to the sewage discharging duct 52, as shown in FIG. 5A. It has a communicating hole 541 leading to the sewage discharging duct 52. The connector 54 comprises a female connecting portion 543 formed into a taper so that the opening area of the female connecting portion 643 is enlarged toward the tip, on the periphery of an end of the connector 54 which is to be connected to the faucet 23.

The connector 55 has a communicating hole 551 leading to the base water feeding duct 63, as shown in FIG. 6A. The connector 55 also comprises a male connecting portion 563 of which periphery of an end to which the faucet 24 is to be connected is turned up to form an umbrella-like shape. In a groove provided on the tip of the turnup, a gasket 554 is provided so that the airtight connection between the female connecting portion 243 and a male connecting portion 553 can be realized.

The shifter 56 is provided under the bottom beam 510, as shown in FIG. 2. It moves the expanders 51, 61 placed on the bottom beam 610 along the traveling direction of the railway vehicle 90 according to instructions from the control device 79. This shifter 56 corresponds to the traveling direction shifting means of the present invention.

The ground side cover 57 is arranged on the ceiling part of the waiting location 48. It is opened and closed according to instructions from the control device 79. As shown in FIG. 3, this ground side cover 57 consists of two covers 570; 571 which swing open on fulcra provided in the cross direction of the railway vehicle 90. The width of these covers 570, 571 is determined so that they fall short of the bottom part 94 of the railway vehicle 90 when they are opened. The ground side cover 47 is constituted in the same manner as the ground side cover 57.

Constitution of the third feeding/discharging opening shifting device 60 is explained hereafter.

This third feeding/discharging opening shifting device 60 comprises the expander 61, a water feeding duct 62, a water discharging duct 63, a connector 64, a connector 65, the shifter 56, and the ground side cover 57. The third supply/discharging opening shifting device 60 is installed within a waiting location 58.

The shifter 56 and ground side cover 57 have been described in the above. Therefore, the descriptions thereof are not repeated.

The expander 61 is constituted from a multiple-layered airing which is composed of a plurality of expandable airings that are layered in their expanding direction. Each of the airings is designed to be expanded perpendicularly toward the railway vehicle 90 from the waiting location 58, when the compressed air is supplied from the ground equipment 70. This expander 61 is arranged above the other end of the longitudinal bottom beam 510 along the traveling direction of the railway vehicle 90.

The water feeding duct 62 is for sending water into the water tank 30 from the ground equipment 70 side via the water feeding duct 31. It is connected to the ground equipment 70 side through the middle of a ring of the expander 61. This water feeding duct 62 is a flexible tube, and has a sufficient length on the ground side to be capable of being moved by the expander 61.

The water discharging duct 63 is for discharging water collected in the water tank 30 to the ground equipment 70 side via the water discharging duct 32. It is connected to the ground equipment 70 side through the middle of the ring of the expander 61. This water discharging duct 63 is also a flexible tube, and has a sufficient length on the ground side to be capable of being moved by the expander 61.

The connector 64 has a communicating hole 641 leading to the water feeding duct 62, as shown in FIG. 6A. The connector 64 comprises a male connecting portion 643 of which periphery of an end to which the faucet 33 is to be connected is turned up to form an umbrella-like shape. In a groove provided on the tip of the turnup, a gasket 644 is provided so that the airtight connection between the female connecting portion 333 and the male connecting portion 643 can be realized.

The connector 65 is connected to the water discharging duct 63, as shown in FIG. 5A. It has a communicating hole 651 leading to the water discharging duct 63. The connector 65 also comprises a female connecting portion 653 formed into a taper so that the opening area of the female connecting portion 653 is enlarged toward the tip.

Now, constitution of the ground equipment 70 is described.

This ground equipment 70 comprises a parking surveillance camera 71, a vehicle parking position determination unit 72, a compressed air pump 73, a refuse vacuuming unit 74, a sewage sucking unit 75, a water feeding valve 76, a base water feeding valve 77, a water discharging pump 78, and a control device 79, as shown in FIG. 1.

The parking surveillance camera 71 takes a picture of the train and determines whether the train composed of the railway vehicle 90 is parked. It photographs the position where the train is parked at all times.

The vehicle parking position determination unit 72 detects the position of a marker 99 painted on the railway vehicle 90, and determines whether there is a gap between the predetermined parking position at which the railway vehicle 90 is to be parked and the actual parking position at which the railway vehicle 90 is actually parked.

The compressed air pump 73 supplies compressed air for expanding and contracting the expanders 41, 42, 51, 61 and for being spouted inside the refuse reservoir 10. The compressed air pump 73 and expanders 41, 42, 51, 61 correspond to the feeding/discharging opening shifting means of the present invention.

The refuse vacuuming unit 74 is connected to the refuse discharging duct 43. It vacuums the refuse collected inside the refuse reservoir 10 and sends the vacuumed refuse into a refuse storage facility not shown. It is operated based on a process in the control device 79. The refuse vacuuming unit 74 corresponds to the vacuuming means of the present invention.

The sewage sucking unit 75 is connected to the sewage discharging duct 52. It sucks the sewage collected inside the sewage tank 20 from the sewage tank 20 and sends the sucked sewage into a sewage storage facility not shown. It is operated based on a process in the control device 79.

The water feeding valve 76 is provided at a connecting point where a water line and the water feeding duct 62 are connected. As this water feeding valve 76 is opened, it is possible to feed water to the water tank 30 via the connector 64. It is opened and closed based on a process in the control device 79.

The base water feeding valve 77 is provided at a connecting point where the water line and the base water feeding duct 53 are connected. As this base water feeding valve 77 is opened, it is possible to feed base water to the sewage tank 20 via the connector 55.

It is opened and closed based on a process in the control device 79.

The water discharging pump 78 is connected to the discharging duct 63. It discharges water stored inside the water tank 30 from the water tank 30 via the connector 65, and sends the discharged water to a sewage line not shown. It is operated based on a process in the control device 79.

The control device 79 performs a parking verifying process, a refuse discharging process, a sewage discharging and water feeding process later explained.

It controls the overall automation system 1 for train maintenance of the present embodiment.

The refuse vacuuming unit 74, sewage sucking device 75, and water feeding valve 76 correspond to the feeding/discharging means of the present invention.

Processes to be performed in the control device 79 for controlling the automation system 1 constituted as above are described hereafter.

The control device 79 firstly performs the parking verifying process to verify that the train is parked.

Figure 7:
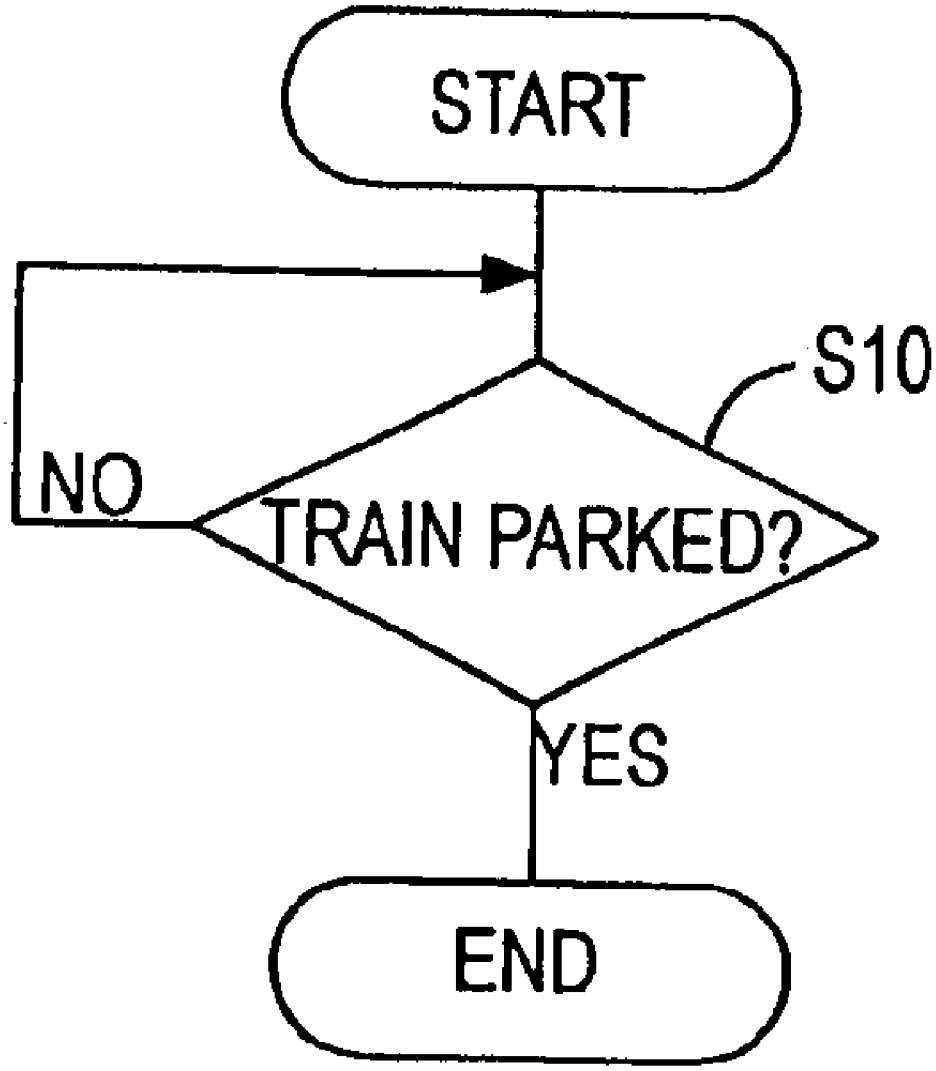
FIG. 7 is a flowchart of a parking verifying process.

FIG. 7 is a flowchart of this parking verifying process.

When the parking verifying process is started, the control device 79 activates the parking surveillance camera 71 and determines whether the train entering the station yard, etc. is parked (S10). If the train is not parked (S10: NO), the process returns to step S10.

If the railway vehicle 90 is parked (S10: YES), the process is ended. The step S10 corresponds to a process performed by the parking determination means of the present invention.

Figure 8:
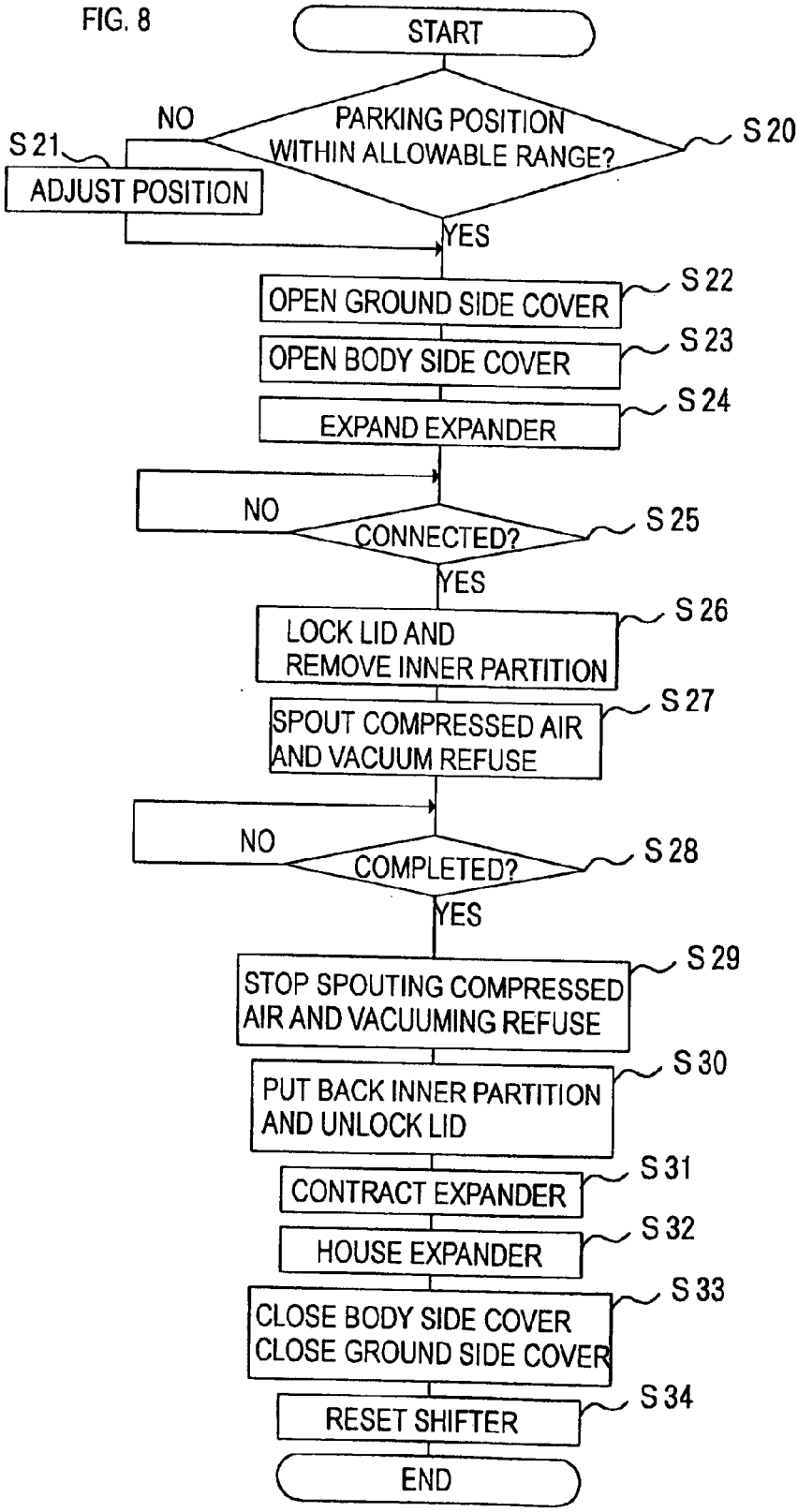
FIG. 8 is a flowchart of a refuse discharging process to be performed upon discharge of the refuse from the refuse reservoir.

After performing the parking verifying process as above, the control device 79 performs the refuse discharging process for discharging the refuse from the refuse reservoir 10. FIG. 8 is a flowchart of the refuse discharging process, and FIGS. 9A–9F are explanatory views illustrating movements of the respective devices in the refuse discharging process. In FIGS. 9A–9F, only the reference numbers for the devices operated in the respective steps are shown.

When the refuse discharging process is started, the control device 79 determines whether the railway vehicle 90 is parked within an allowable range of the predetermined parking position using the vehicle parking position determination unit 72 (S20). If the railway vehicle 90 is parked beyond the allowable range (S20: NO), the control device 79 activates the shifter 46 and shifts the expanders 41, 42 together with the bottom beam 410 to eliminate the gap (S21). Then, the process proceeds to step S22. Steps S20 and S21 correspond to a process performed by the access movement control means of the present invention.

Figures 9A, 9B, 9C, 9D, 9E, 9F:
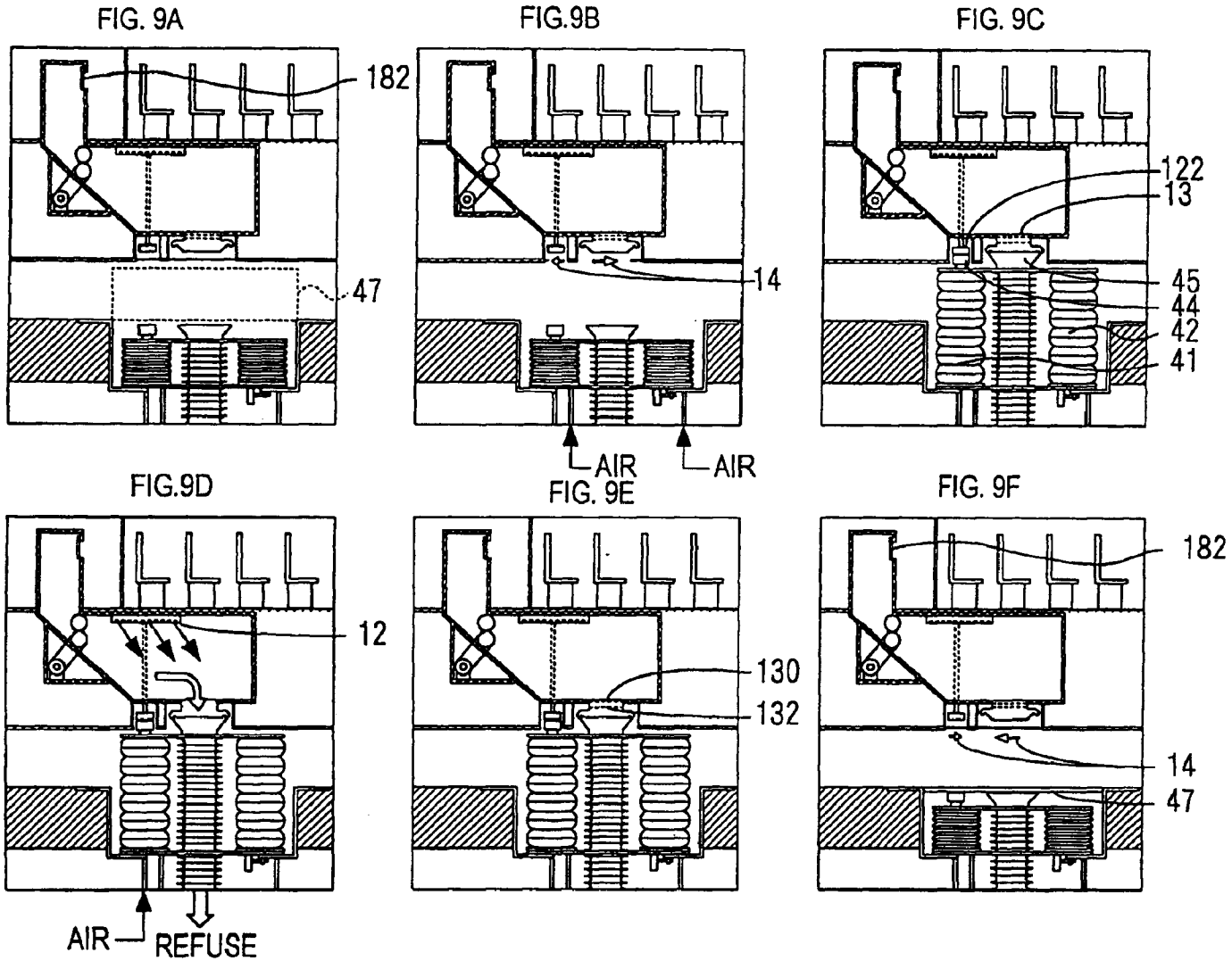
FIGS. 9A–9F are explanatory views illustrating movements of the respective devices upon discharge of the refuse from the refuse reservoir.

In step S22, the control device 79 opens the ground side cover 47 (S22: FIG. 9A), opens the body side cover 14 (S23: arrow in FIG. 9B), activates the compressed air pump 73 to supply the compressed air into the expanders 41, 42, expands the expanders 41, 42 to move the connectors 44 and 45 close toward the railway vehicle 90, and performs access movement in which the connectors 44, 45 are connected with the respective faucets 122, 13 (S24: FIG. 9C). In this case, even if the positions of the connector 45 and the faucet 13 are not aligned across the traveling direction as shown in FIG. 4A, the control device 79 moves the connector 45 close toward the faucet 13, forces the female connecting portion 453 to abut the male connecting portion 136 and moves the connector 45 upward as it is. Then, the female connecting portion 453 moves along the taper, and connection between the female connecting portion 453 and the male connecting portion 136 is ensured (see FIG. 4B). Accordingly, the aforesaid gap elimination does not necessarily have to be performed with high precision. It is sufficient to park the railway vehicle within an allowable range of the predetermined parking position. This step S24 corresponds to a process performed by the access movement control means of the present invention.

Subsequently, the control device 79 determines whether the connector 44 and the faucet 122, and the connector 45 and the faucet 13 are respectively connected by means of a not shown sensor equipped with the railway vehicle 90 (S25). If they are not connected (S25: NO), the process returns to S26. If they are connected (S25: YES), the control device 79 stops supplying the compressed air into the expanders 41, 42, locks the lid 182 of the trash box portion 18, and removes the second inner partition 132 and the first inner partition 130 in this order (S26: see FIG. 4C). Then, it supplies the compressed air to the compressed air supplying unit 12 to supply the air into the refuse reservoir 10, activates the refuse vacuuming unit 74, and starts suction of the refuse inside the refuse reservoir 10 (S27: FIG. 9D). Since the refuse is ground beforehand by the grinder 11, it is discharged smoothly. In addition, since the compressed air spouting from the compressed air supplying unit 12 blows the refuse, the refuse is discharged without being stuck. Step S25 corresponds to a process performed by the connection determination means of the present invention, and step S27 corresponds to a process performed by the feeding/discharging movement control means of the present invention.

When the suction of the refuse is started, it is determined whether the refuse vacuuming unit 74 has been operated normally for a predetermined suction period (S28). The refuse vacuuming unit 74 is designed to suck the refuse at a certain suction rate per hour. In the present embodiment, the suction period for which the refuse vacuuming unit 74 is operated is preset to a period for which the refuse filling the refuse reservoir 10 can be removed all. If the suction period has not yet passed in step S28 (S28: NO), the process returns to step S28. If the suction period has passed (S28: YES), the control device 79 stops operating the refuse vacuuming unit 74 and supplying the compressed air into the compressed air supplying unit 12 (S29), brings the first inner partition 130 and the second inner partition 132 back to their original positions in this order, and unlocks the lid 182 of the trash box portion 18 (S30: FIG. 9E). It further opens a not shown discharging valve to discharge the air inside the expanders 41, 42, moves connectors 44 and 45 away from the railway vehicle 90, and performs the disconnection movement which allows the respective connectors 44, 45 to be disconnected from the faucets 122, 13, respectively (S31). Step S28 corresponds to a process performed by the feeding/discharging completion determination means, and step S31 corresponds to a process performed by the disconnection movement means of the present invention.

Then, the control device 74 confirms that the expanders 41, 42 are brought back within the waiting location 48 by means of a not shown sensor (S32). Subsequently, as shown in FIG. 9F, the control device 74 closes the body side cover 14, closes the ground side cover 47 (S33), activates the shifter 46 to bring back the expanders 41, 42 to their original position (S34), and ends this refuse discharging process.

Figure 10:
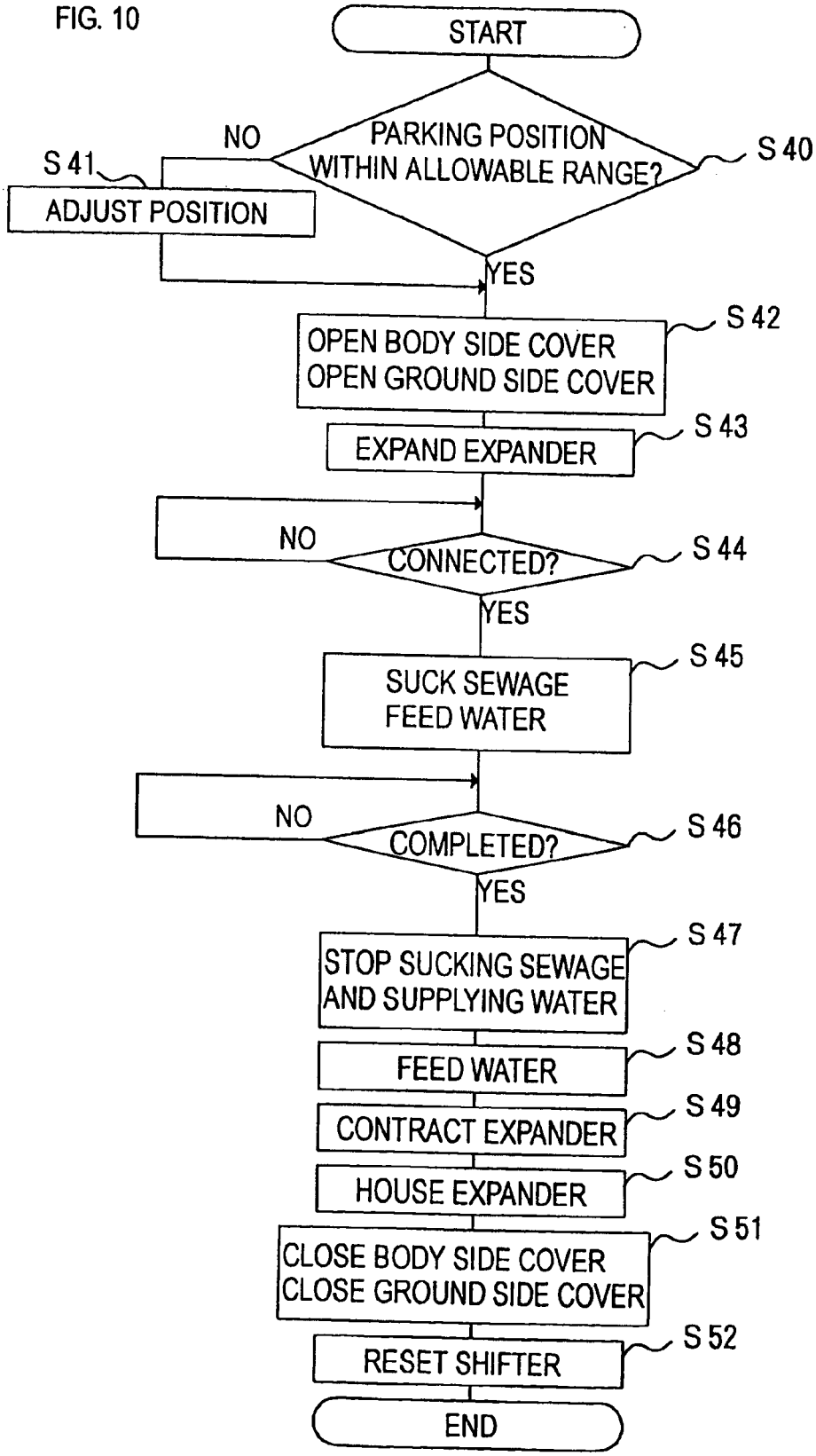
FIG. 10 is a flowchart of a sewage discharging process and a water feeding process for feeding water to the water tank, to be performed upon discharge of the sewage from the sewage tank.

Aside from or in concurrence with the above refuse discharging process, the control device 79 performs the sewage discharging and water feeding/discharging process which allows the sewage to be discharged from the sewage tank 20 and the water to be fed into and discharged from the water tank 30 after the aforementioned parking verification process. FIG. 10 is a flowchart of the sewage discharging and water feeding/discharging process, and FIGS. 11A–11E are explanatory views illustrating movements of the respective devices in this process. In FIGS. 11A–11E, only the reference numbers for the devices operated in the respective steps are shown.

When the sewage discharging and water feeding/discharging process is started, the control device 79 firstly determines whether the railway vehicle 90 is parked within an allowable range of the predetermined parking position using the vehicle parking position determination unit 72 (S40). If the railway vehicle 90 is parked beyond the allowable range (S40: NO), the control device 79 activates the shifter 56 and shifts the expanders 51, 52 together with the bottom beam 510 to eliminate the gap (S41). Then, the process proceeds to step S42. Steps S40 and S41 correspond to a process performed by the access movement control means of the present invention.

Figure 11A:
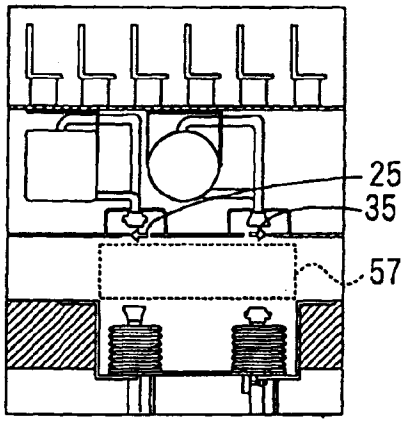
FIGS. 11A–11E are explanatory views illustrating movements of the respective devices upon suction of the sewage from the sewage tank and upon feeding of water to the water tank.
Figure 11B:
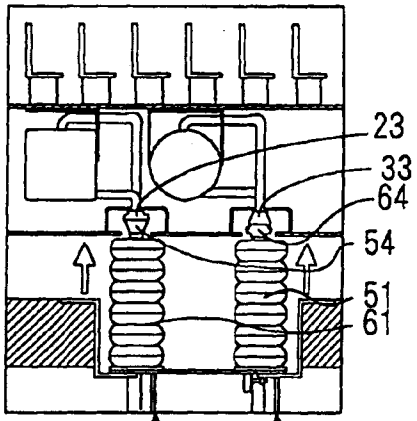

In step S42, the control device 79 opens the ground side cover 57 and the body side covers 25, 35 (S42: arrow in FIG. 11A), activates the compressed air pump 73 to supply the compressed air into the expanders 51, 61, expands the expanders 51, 61 to move the connectors 54, 55, 64, 65 close toward the railway vehicle 90, and performs access movement in which the connectors 54, 55, 64, 65 are connected with the respective faucets 23, 24, 33, 34 (S43: FIG. 11B). In this case, even if the positions of the connector 54, 55, 64, 65 and the faucets 23, 24, 33, 34 are not aligned more or less across the traveling direction as shown in FIGS. 5A and 6A, connection between them is ensured in the same manner as the aforementioned connection between the faucet 13 and the connector 45. This step S43 corresponds to a process performed by the access movement control means of the present invention.

Figure 11C:
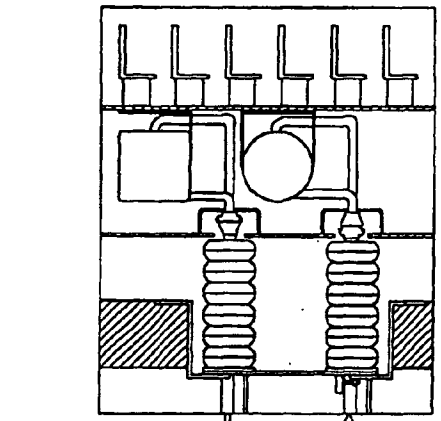
Figure 11D:
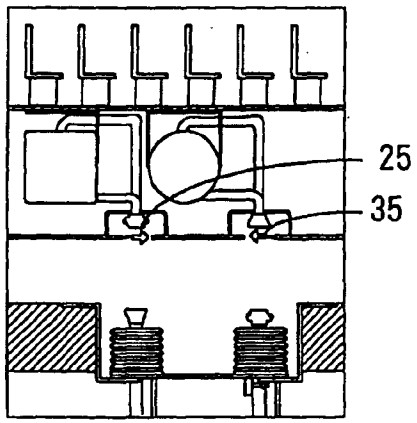

Subsequently, the control device 79 determines whether the connectors 54, 55, 64, 65 and the faucets 23, 24, 33, 34 are respectively connected by means of a not shown sensor equipped with the railway vehicle 90 (S44). If the connection is not detected (S44: NO), the process returns to S44. If the connection is detected (S44: YES), the control device 79 stops supplying the compressed air into the expanders 51, 61, opens the valves 239, 339, as shown in FIGS. 5C and 6C, to activate the sewage sucking unit 75. At the same time, it opens the water feeding valve 76 to start sucking of the sewage collected inside the sewage tank 20 and feeding of water into the water tank 30 (S45: FIG. 11C). As mentioned above, it is necessary to discharge the water stored in the water tank 30 when the water in the water tank has been held more than a certain period of time. In this case, the control device 79 may open the valve 349 (see FIG. 6C) to perform a water discharging process and start supplying water to the water tank 30 (S45), after the connection between the connectors 65, etc. and the faucets 34, etc. is detected (S40: YES). Step S44 corresponds to a process performed by the connection determination means of the present invention, and step S45 corresponds to a process performed by the feeding/discharging movement control means of the present invention.

Then, it is determined whether the sewage is removed completely and the water tank 30 is filled with water (S46). The sewage sucking unit 75 is designed to suck the sewage at a certain suction rate per hour. Therefore, whether the sewage is completely removed is determined on whether a period of time required to remove the sewage filling the sewage tank 20 has passed. The water tank 30 is equipped with a not shown priming-water detector. Whether water has filled the water tank 30 is determined on whether the priming-water detector detected that the water tank 30 is filled with water. Step S46 corresponds to a process performed by the feeding/discharging completion determination means.

In step S46, if it is determined negatively (S46: NO), the process returns to step S46. If it is determined affirmatively (S46: YES), the control device 79 closes the valves 239, 339 to stop the operation of the sewage sucking unit 75, and closes the water feeding valve 76 to stop suction of the sewage and feeding of water (S47). Then, as to the sewage tank 20, the base water feeding valve 77 and the valve 249 are opened after the sewage is removed, and a predetermined amount of base water is fed (S48). The base water may be fed during discharge of the sewage.

Subsequently, a not shown discharging valve is opened to discharge the air inside the expanders 51, 61, and the disconnection movement in which the connectors 54, 55, 64, 65 are disconnected from the faucets 23, 24, 33, 34 is performed (S49). Step S49 corresponds to a process performed by the disconnection movement means of the present invention.

Figure 11E:
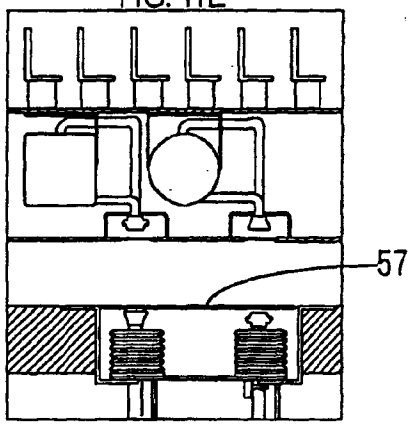

Then, the control device 74 confirms that the expanders 51, 61 are placed within the waiting location 58 by means of a not shown sensor (S50). Subsequently, the control device 74 closes the body side covers 25, 35 (FIG. 11D), closes the ground side cover 57 (S51: FIG. 11E), moves back the shifter 56 to its original position (S52), and ends this sewage discharging and water feeding/discharging process.

Utilization of the automation system 1 for train maintenance of the present invention which operates as above produces advantages as below.

Firstly, in the automation system 1 for train maintenance of the present embodiment, the operation for connecting and disconnecting the connectors 45, 54, 65, 64, 65 (which correspond to the feeding/discharging opening of the present invention) to and from the refuse reservoir 10, sewage tank 20 and water tank 30, and the operation for discharging the refuse and sewage and feeding water by the refuse vacuuming unit 74, sewage sucking unit 75 and opening and closing of the water feeding valve 76 are automated. Therefore, utilization of this automation system 1 realizes automatic train maintenance without human intervention.

The automation system 1 of the present embodiment makes adjustment to eliminate the gap when the actual parking position and the predetermined parking position differ (S20–S21). As a result, even if the railway vehicle 90 is not parked at the predetermined position, the connectors 45, 54, 55, 64, 65 are automatically moved to the appropriate position where train maintenance can be performed. Therefore, utilization of the automation system 1 of the present embodiment enables automatic train maintenance even if the railway vehicle 90 is not parked at the right position.

In the automation system 1 of the present embodiment, the multiple-layered airing is adopted. Therefore, when the railway vehicle 90 vibrates during getting on and off of the passengers, the expanders 41, 42, 51, 61 also vibrate to the vibration of the railway vehicle 90. Consequently, disconnection of the connectors 45, 54, 55, 63, 64 from the refuse reservoir 10, sewage tank 20 and water tank 30 are avoided. Utilization of the automation system 1 of the present embodiment ensures reliable train maintenance even during getting on and off of the passengers.

In the automation system 1 of the present embodiment, the refuse collected in the refuse reservoir 10 is ground. Therefore, even the refuse larger than the cross section of the refuse discharging duct 43 is discharged without fail.

In the automation system 1 for train maintenance of the present embodiment, when the refuse is vacuumed, the mouth 180 provided in the passenger cabin of the railway vehicle 90 is sealed with the lid 182. Therefore, suction of the air in the passenger cabin is avoided, and discharge of the refuse is performed without offending the passengers. In addition, in the automation system 1 for train maintenance of the present embodiment, the compressed air supplying unit 12 supplies the air into the refuse reservoir 10 upon vacuuming. Therefore, suction of the air initially present inside the refuse reservoir 10 which is airtight by sealing of the mouth 180 does not hinder continuous discharge of the refuse in virtue of the supplied air. Even if the air pressure inside the refuse reservoir 10 is lowered, collapse of the refuse reservoir 10 can be avoided.

In the automation system 1 of the present embodiment, the air supplied into the refuse reservoir 10 spouts toward the stored refuse. Therefore, the refuse is diffused and can be discharged without being stuck inside the refuse reservoir 10.

The automation system 1 of the present embodiment ensures connection of the connectors 45, etc. to the refuse reservoir 10, etc., even if the railway vehicle 90 is not parked at the right position and the connectors 45, etc. are more or less off the attaching position at which the connectors 45, etc. are to be attached to the refuse reservoir 10, etc. If the positions of the male connecting portions 136, etc are within the opening area of the female connecting portions 453, etc., either of the male connecting portions 136, etc. or the female connecting portions 142, etc. moves along the taper while the connectors 45, etc. are approaching toward the railway vehicle 90. As a result, the connectors 45, etc. are lead to the position capable of being connected to the refuse reservoir 10, etc., and connections of the connectors 45, etc. to the refuse reservoir 10, etc. are ensured.

The automation system 1 for train maintenance of the present embodiment is provided with the partition walls 15, 26, 36 to prevent fluctuation of air pressure from affecting the air inside of the railway vehicle 90 through the openings on the railway vehicle 90 for connecting the connectors 44, 46, 54, 55, 64, 65 to the refuse reservoir 10, sewage tank 20 and water tank 30 equipped with the railway vehicle 90. Accordingly, even if the air pressure is fluctuated due to passing of the other trains during the train maintenance, the fluctuation does not affect the air inside the railway vehicle 90. Thus the environment inside the railway vehicle 90 is kept comfortable.

In addition, train maintenance had been conventionally performed by a laborer by hand from the front vehicle to the succeeding vehicles one after another. Then, it was necessary to park the train for a long time for maintenance. However, if all the railway vehicles are brought under maintenance at a time by using the automation system 1 for train maintenance of the present embodiment, maintenance time required for train maintenance can be considerably reduced. Thus operating performance of trains can be raised.

The present invention should not be limited to the above described embodiment, and other modifications and variations might be possible without departing from the technical scope of the invention.

For instance, the ground side covers 47, 57 may be slid to the traveling direction to be opened and closed.

If the inner partition 130 can seal the refuse reservoir 10 at any given time, or if it is not required to seal the refuse reservoir 10 regardless of the refuse being stuck in the space where the inner partition 130 is provided, the second inner partition 132 can be omitted.

In the present embodiment, the male connecting portion 136 is provided with the faucet 13 for discharging the refuse, and the female connecting portion 453 is provided with the connector 45, for example. However, a female connecting portion may be provided with the faucet 13, and a male connecting portion may be provided with the connector 45.

The automation system of the present embodiment may be used as a unit for feeding a fuel to a power source car connected to a sleeper train, electricity supply facilities of a maglev train, or a railway motor car.

The multiple-layered airing is used for the expanders 41, 42, to prevent the coupled faucet 13 and connector 45 from being disconnected when the railway vehicle 90 is vibrated during getting on and off of the passengers. However, if such vibration is not necessarily taken into account, the expanders 41, 42, 51, 61 may be constituted from a hydraulic jack, etc.

The automation system 1 of the present embodiment may only be provided with one of these: equipment for discharging refuse, equipment for discharging sewage, and equipment for feeding water.

If the automation system 1 is used for a railway vehicle of the conventional railway lines, the body side cover 14 and partition wall 15 are not necessarily required. Because passing of the other trains does not cause substantial change in the air pressure and there is little influence on the air inside of the railway vehicle 90.

It is preferable that a device space where the devices which support the automation system 1 are installed and a passing space where the railway vehicle 90 passes are not communicated with each other via the waiting locations 48, 58, and that the device apace is sealed against the waiting locations 48, 58. The devices which support the automation system 1 are, for example, laying pipes via which the compressed air is sent to the waiting locations 48, 58, the compressed air pump 73, etc. In this manner, even if the air pressure in the passing space is fluctuated due to passing of the other trains and there is a laborer who performs maintenance on the devices in the device area, the fluctuation in the air pressure in the passing space does not affect the laborer. The laborer can perform maintenance on the devices in a comfortable environment.

In the present embodiment, expanders 61, etc. of the automatic system 1 are expanded and contracted in the vertical direction under the railway vehicle 90. However, for example, if the water tank 30, etc. are provided on the side face of the railway vehicle 90, or on the ceiling, the expanders 61, etc. may be provided on the ground, so that the connectors 64; etc. can be moved close to or away from the railway vehicle 90 in the lateral direction, or in the vertical direction above the railway vehicle 90.

Industrial Availability

As described in details in the above, the automation system for train maintenance of the present invention can automate maintenance of a train without human intervention.

What is claimed is:

1. An automation system for train maintenance that performs train maintenance when the train is parked, comprising:

storing means provided in a railway vehicle forming the train, feeding/discharging means, installed on the ground, for feeding the storage to be supplied to the storing means or discharging storage to be discharged from the storing means via a feeding/discharging opening;

feeding/discharging opening shifting means for performing access movement in which the feeding/discharging opening of the feeding/discharging means is moved close toward the railway vehicle from a waiting location on the ground to connect the feeding/discharging opening to the storing means, and disconnection movement in which the feeding/discharging opening connected to the storing means is moved away from the railway vehicle toward the waiting location to disconnect the feeding/discharging opening from the storing means;

parking determination means for determining whether the trains is parked;

connection determination means for determining whether the feeding/discharging opening is connected to the storing means;

feeding/discharging completion determination means for determining whether the feeding of the storage to be supplied or the discharge of the storage to be discharged is completed;

access movement control means for urging the feeding/discharging opening shifting means to perform the access movement when the parking determination means determines that the train is parked;

feeding/discharging movement control means for urging the feeding/discharging means to feed the storage to be fed or to discharge the storage to be discharged when the connection determination means determines that the feeding/discharging opening is connected to the storing means; and disconnection movement control means for urging the feeding/discharging opening shifting means to perform the disconnection movement when the feeding/discharging completion means determines that the feeding of the storage to be supplied or the discharge of the storage to be discharged is completed; and traveling direction shifting means for shifting the feeding/discharging opening along the traveling direction of the train, wherein said access movement control means urges said traveling direction shifting means to move said feeding/discharging opening to eliminate a gap between an actual parking position and a predetermined parking position of the train and urges said feeding/discharging opening shifting means to perform said access movement, when said parking determination means determines that said train is parked and there is such a gap.

2. The automation system for train maintenance as set forth in claim 1 wherein said feeding/discharging opening shifting means is constituted from a vibration absorbent which absorbs vibration of said railway vehicle.

3. The automation system for train maintenance as set forth in claim 2 wherein said feeding/discharging opening shifting means is constituted from a multiple-layered airing which is composed of expandable airings that are layered in their expanding direction.

4. The automation system for train maintenance as set forth in claim 1 wherein said storing means comprises grinding means for grinding said storage to be discharged inside the storing means.

5. The automation system for train maintenance as set forth in claim 1 wherein said feeding/discharging means corresponds to vacuuming means for vacuuming and discharging said storage to be discharged from said storing means, the storing means comprising:

a lid capable of sealing a mouth provided inside said railway vehicle for throwing the waste into the storing means; and air supplying means for supplying the air into the storing means, wherein the mouth is sealed with the lid and the air is supplied from the air supplying means into the storing means, while the vacuuming means vacuums and discharges the storage to be discharged.

6. The automation system for train maintenance as set forth in claim 5 wherein said air supplying means diffuses said storage to be discharged by means of the air supplied into said storing means.

7. The automation system for train maintenance as set forth in claim 1 further comprising:

female connecting means provided in one of a connection opening of said storing means and the feeding/discharging opening of said feeding/discharging means and formed into a taper so that the opening area of the female connecting means is enlarged toward the tip; and male connecting means provided in the other of the connection opening of the storing means and the feeding/discharging opening of the feeding/discharging means to be connected to the female connecting means, wherein said access movement control means urges said feeding/discharging opening shifting means to perform said access movement when the female connecting means faces the male connecting means.

8. The automation system for train maintenance as set forth in claim 1 comprising isolation means that prevents the fluctuation in the air pressure from affecting the environment inside the railway vehicle through an opening provided on the railway vehicle for connecting said feeding/discharging opening to said storing means installed in the railway vehicle.

* * * * *